US007091874B2

(12) United States Patent
Smithson

(10) Patent No.: US 7,091,874 B2
(45) Date of Patent: Aug. 15, 2006

(54) TEMPERATURE COMPENSATED WARNING LIGHT

(76) Inventor: Bradley D. Smithson, 2803 Lower 6 Mile Rd., Nelson BC. (CA)

( * ) Notice: Subject to any disclaimer, the term of this patent is extended or adjusted under 35 U.S.C. 154(b) by 252 days.

(21) Appl. No.: 10/418,818

(22) Filed: Apr. 18, 2003

(65) Prior Publication Data

US 2004/0207532 A1 Oct. 21, 2004

(51) Int. Cl.
*G08B 5/22* (2006.01)

(52) U.S. Cl. ..... 340/815.45; 340/815.4; 340/584; 340/815.49; 315/291; 315/307

(58) Field of Classification Search ..... 340/815.45, 340/815.4, 815.49, 581, 584; 315/291, 307, 315/311; 345/82; 362/800
See application file for complete search history.

(56) References Cited

U.S. PATENT DOCUMENTS

| | | | | |
|---|---|---|---|---|
| 3,784,809 | A | 1/1974 | Smith | |
| 5,006,971 | A | 4/1991 | Jenkins | |
| 5,224,773 | A | 7/1993 | Arimura | |
| 5,361,190 | A | 11/1994 | Roberts et al. | |
| 5,422,623 | A | 6/1995 | Bader et al. | |
| 5,517,388 | A | 5/1996 | Hutchinson | |
| 5,528,474 | A | 6/1996 | Roney et al. | |
| 5,561,346 | A | 10/1996 | Byrne | |
| 5,567,036 | A | 10/1996 | Theobald et al. | |
| 5,585,783 | A | 12/1996 | Hall | |
| 5,608,290 | A | 3/1997 | Hutchinson et al. | |
| 5,642,933 | A | 7/1997 | Hitora | |
| 5,644,291 | A | 7/1997 | Jozwik | |
| 5,685,637 | A | 11/1997 | Chapman et al. | |
| 5,766,801 | A | 6/1998 | Inoue et al. | |
| 5,806,965 | A | 9/1998 | Deese | |
| 5,838,247 | A | 11/1998 | Bkadowski | |
| 5,850,126 | A | 12/1998 | Kanbar | |
| 5,890,794 | A | 4/1999 | Abtahi et al. | |
| 5,893,626 | A | 4/1999 | Poling | |
| 5,912,568 | A * | 6/1999 | Kiley | 327/108 |
| 5,929,788 | A | 7/1999 | Vukosic | |
| 5,939,996 | A | 8/1999 | Kniveton et al. | |
| 5,952,913 | A | 9/1999 | Cioletti et al. | |
| 5,974,721 | A | 11/1999 | Johnson et al. | |
| 5,975,352 | A | 11/1999 | Spriggs et al. | |
| 5,984,494 | A | 11/1999 | Chapman et al. | |

(Continued)

FOREIGN PATENT DOCUMENTS

GB 2069257 A * 2/1980

(Continued)

*Primary Examiner*—Thomas J. Mullen, Jr.
*Assistant Examiner*—Daniel Previl
(74) *Attorney, Agent, or Firm*—Shughart Thomson & Kilroy PC; Dennis A. Crawford

(57) ABSTRACT

A temperature compensated warning light includes banks of high output light emitting diodes (LED's), one or more drivers connecting the LED banks to a control processor, and a temperature sensor thermally coupled to the LED's to provide a temperature signal indicative of the temperature of the LED's to the processor. The processor pulse width modulates a base frequency signal to the LED's in such a manner as to maintain a constant brightness of the LED's as the temperature of the LED's varies. The processor also monitors supply voltage and further varies the pulse width of the base frequency signal to compensate for supply voltage variation. The base frequency signal is modulated by a flash signal to create desired flash patterns.

12 Claims, 2 Drawing Sheets

U.S. PATENT DOCUMENTS

| | | | | |
|---|---|---|---|---|
| 5,991,363 | A | 11/1999 | Thomson | |
| 6,013,985 | A | 1/2000 | Green et al. | |
| 6,086,220 | A | 7/2000 | Lash et al. | |
| 6,183,100 | B1 | 2/2001 | Suckow et al. | |
| 6,191,541 | B1 * | 2/2001 | Patel et al. | 315/307 |
| 6,441,558 | B1 * | 8/2002 | Muthu et al. | 315/149 |
| 6,909,377 | B1 * | 6/2005 | Eberl | 340/815.4 |
| 2002/0044454 | A1 | 4/2002 | Roller et al. | |

FOREIGN PATENT DOCUMENTS

| | | | |
|---|---|---|---|
| GB | 2069257 | A | 8/1981 |

* cited by examiner

BATTERY
POWER SUPPLY
VOLTAGE REFERENCE
PWM CONTROLLER
DRIVER
LED TEMPERATURE SENSOR
LED BANKS
26
28
1
14
32
34
24
30
4
2
20
3
29

BATTERY
POWER SUPPLY
VOLTAGE REFERENCE
PWM & LED BANK CYCLING CONTROLLER
DRIVERS
LED TEMPERATURE SENSOR
LED BANKS
26
28
32
34
40
30
4
42
20
2
3
29

TEMPERATURE COMPENSATED WARNING LIGHT

BACKGROUND OF THE INVENTION

Warning lights of various descriptions are used in fixed situations and on vehicles to increase the visibility of possibly hazardous activities or situations. Warning lights are used on construction and repair vehicles, police and security vehicles, ambulances and fire response vehicles, and the like. Warning lights are usually flashed or operated in a manner which creates a flashing appearance, such as by actual or simulated rotation, to increase visibility of the warning light and to draw attention to the hazardous situation. Various standard colors are used to designate the type of vehicle a light is used on, such as: yellow or amber, sometimes white, for general caution on non-emergency and non-official vehicles; red to indicate official emergency response vehicles such as fire, ambulance, and often police; and blue to indicate police vehicles in some districts. Sometimes, combinations of lights of different colors are used for different functions on a particular vehicle, such as amber caution lights on a police car for use in a stop to assist a stranded motorist, in addition to red and/or blue rotating lights for law enforcement purposes.

In the past, many types of warning lights, particularly for vehicles, employed incandescent types of lamps. Although incandescent lamps have provided useful service for illumination and warning lights, there are some negative aspects to incandescent lamps. Incandescent lamps with evacuated glass envelopes are susceptible to breakage. The filaments used in such lamps are also vulnerable to breakage from shocks, vibration, and fatigue over time from thermal expansion and contraction. Incandescent lamps produce heat by the mechanism through which they produce light, namely electrical resistance.

Other illumination sources besides incandescent lamps have been considered and implemented for both illumination purposes and signaling or warning light purposes, such as ionized gas or gas discharge lights (xenon, halogen, etc.) and solid state lights, including light emitting diodes (LED's). Light emitting diodes are considerably less vulnerable to damage from shock and vibration than incandescent lamps and consume less electrical power for a comparable level of illumination. More recently, light emitting diodes have been developed which can be operated at illumination levels which meet the photometric standards required by regulations and industry standards for warning lights. However, operating light emitting diodes at high levels of illumination generates heat within the diodes, which results in a decrease in light output when the diodes are so heated. Light output from light emitting diodes also changes with fluctuations in the voltage of the power source which powers them. There is, thus, a need for a warning light arrangement using light emitting diodes which operates the diodes at a desirably high level of light output and at a consistent and predictable level of light output.

SUMMARY OF THE INVENTION

The present invention provides a warning light arrangement or apparatus incorporating light emitting diodes which compensates for variations in temperature and/or source voltage to maintain a photometric output level of the unit within a desired range. The apparatus includes a plurality of high output light emitting diodes which can be mounted either in a single array or in multiple arrays or banks for omnidirectional or linear sequencing, depending on the type of light apparatus needed. A driver circuit connects the banks of diodes to an electrical power source, such as a battery, and is enabled by a microcontroller or controller. A single driver can be used if the LED's are activated in unison, or multiple drivers can be used to activate the banks or arrays in selected sequences, as well as in unison.

The controller illuminates the LED's by an activation signal which has a base or minor pulse rate high enough to give the appearance of a continuous on-state when the LED's are illuminated. The controller outputs the activation signal at a major or flash sequence rate, which can be a simple, symmetrical on/off flash pattern or a complex sequence of multiple flash bursts. The flash patterns can include activating all the diodes in unison or sequencing groups or banks of diodes to create a rotating pattern of an omnidirectional array or a linear pattern of a directional lightbar. The microcontroller employed has the capability of pulse width modulating (PWM) the base pulse component of the activation signal to vary the pulse width of the base pulses for a given pulse rate, which is also referred to as varying the duty cycle or on-time percentage of the pulse signal.

The apparatus includes a temperature sensor which is thermally coupled to at least one of the light emitting diodes to thereby measure an actual temperature, or at least a representative temperature, of the LED's. The preferred temperature sensor outputs a diode temperature signal in which a voltage output of the sensor varies in precise proportion to the diode temperature sensed. The diode temperature signal from the sensor is monitored by the controller, relative to a reference voltage, and is used as a basis for controlling the duty cycle of the base pulse signal component. The controller is calibrated by programming to maintain the light output of the LED's within a desired range. In particular, as the diode temperature increases beyond a given high threshold temperature, the controller reduces the duty cycle of the base pulse component proportionately to thereby reduce the heat generated by the diodes. Conversely, as the temperature of the diodes decreases below a low threshold temperature, the controller proportionately increases the duty cycle of the base pulse component to maintain a constant photometric output of the diodes.

In addition to monitoring the temperature of the diodes, the warning light apparatus of the present invention monitors the voltage level of the power source, since the source voltage can also affect photometric output or brightness of the light emitting diodes. The controller compares the source voltage to a reference voltage level and varies the duty cycle of the base pulse component in proportion to changes in the source voltage to maintain the photometric output level of the diodes within the desired range.

Other objects and advantages of this invention will become apparent from the following description taken in relation to the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

Figure 1:
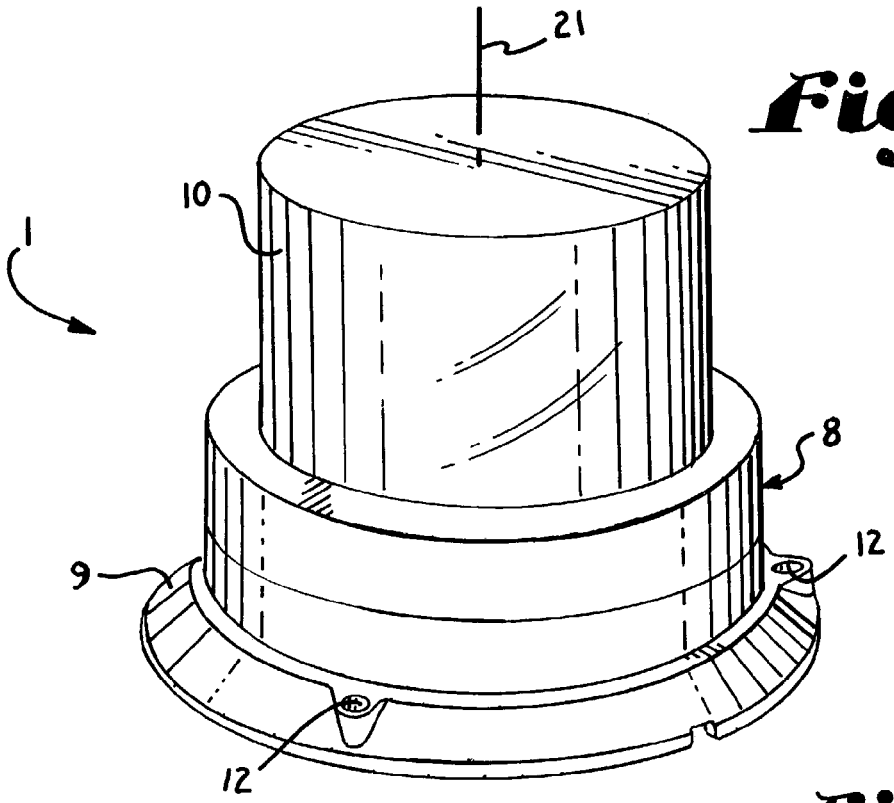
FIG. 1 is a perspective view of a temperature compensated warning light which embodies the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a temperature compensated warning light apparatus or unit which embodies the present invention. The unit 1 includes a plurality of electrical illumination elements such as light emitting diodes (LED's) 2 (FIG. 2), a temperature sensor 3 (FIGS. 3 and 4) thermally coupled to at least one of the diodes 2, and a controller 4 providing an activation signal to the diodes 2. The temperature sensor 3 outputs a diode temperature signal which is monitored by the controller 4. As the diode temperature signal changes in response to temperature changes in the diodes 2, the controller 4 varies a parameter of the activation signal to thereby maintain a relatively stable brightness of the diodes 2.

Figure 2:
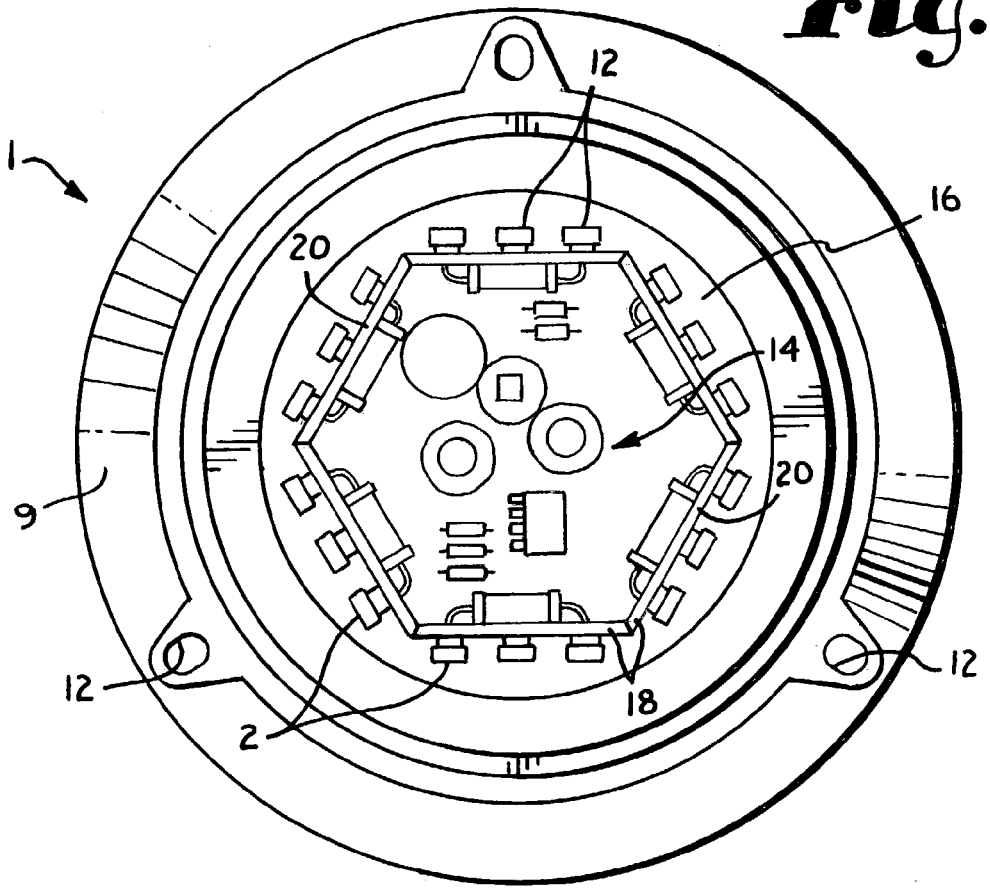
FIG. 2 is a top plan view of the warning light at a somewhat enlarged scale with a lens removed to illustrate internal structural details thereof.

The warning light unit 1 illustrated in FIGS. 1 and 2 includes a housing 8 formed by a mounting base 9 and a colored transparent lens 10. The mounting base 9 may be adapted for permanent mounting, as on a vehicle by way of fasteners (not shown) passing through mounting holes 12. Alternatively, the base 9 may include a magnet (not shown) for temporary mounting on sheet metal of a vehicle, such as on the roof of the vehicle. The lens 10 is a cap-like structure which joins to the base 9, as by being threaded. Alternatively, fasteners, a bayonet arrangement, a snap structure, or the like (not shown) can be employed to join the lens 10 and the base 9. The lens 10 is preferably formed of a transparent plastic of a desired color, such as amber, red, blue, or the like.

The unit 1 includes circuitry 14 mounted on a base circuit board 16 secured to the mounting base 9 and on a plurality of upstanding circuit boards or LED cards 18 mounted on the base circuit board 16. The LED cards 18 have the light emitting diodes 2 mounted thereon, and each card with its diodes 2 and supporting circuitry 14 constitutes an LED bank 20. As illustrated in FIG. 2, there are six LED cards 18 with LED's 2 which are mounted in an outwardly facing arrangement about a central axis 21 (FIG. 1) to radiate in a substantially 360 degree or omnidirectional manner. Alternatively, the unit 1 could include other arrangements of illumination elements, such as a single circuit card 18 with single bank of LED's 2 all facing the same direction, a plurality of banks 20 of LED's 2 arranged in a manner other than in an omnidirectional array, as in a directional type of light bar, or the like.

Figure 3:
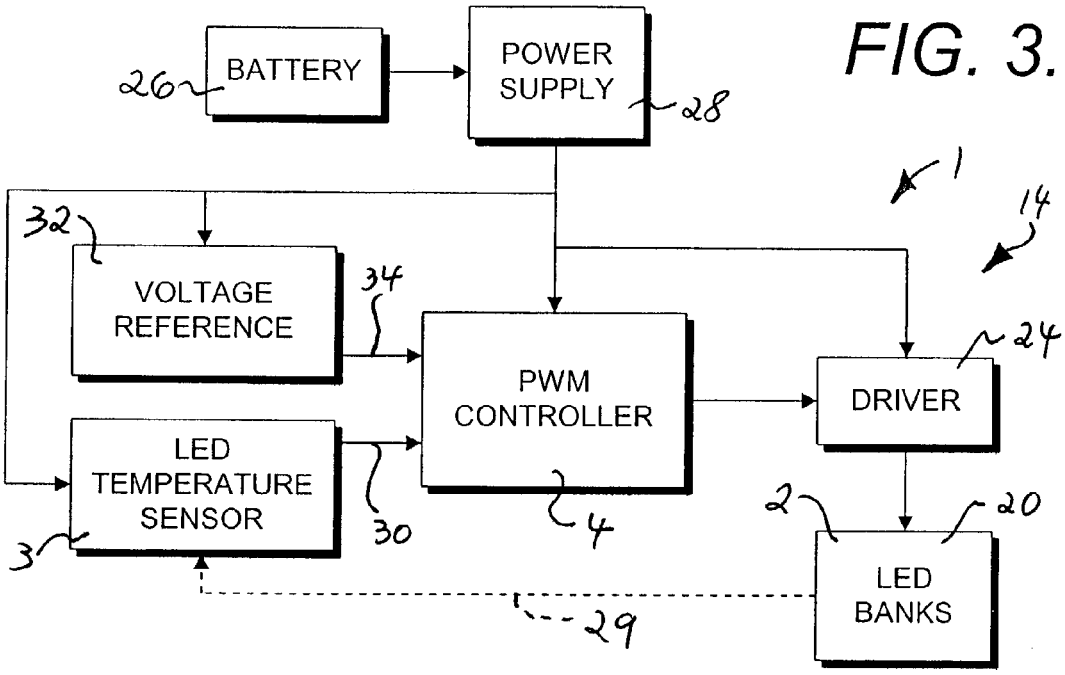
FIG. 3 is a block diagram illustrating principal components of the temperature compensated warning light in which light emitting diodes are flashed in unison.

Referring to FIG. 3, the LED's 2 or LED bank 20 is connected to the controller 4 by a driver 24 which is controlled by an activation signal from the controller 4 to enable the flow of power to the LED's 2 from a battery 26 or other power source through a power supply 28 to activate the LED's 2. The driver 24 may be a power transistor with the capability of conducting the required activation current for the LED's 2 from the power supply 28 when enabled by the controller 4. The controller 4 activates the LED's 2 using a pulsed signal at a base frequency which is high enough to give an appearance of a steady on-state, such as two kilohertz (2 kHz). The controller 4 may also be programmed to activate the LED's 2 in particular flash patterns.

The illustrated controller 4 is preferably a microprocessor or microcontroller which generates the base frequency signal and modulates the base frequency signal by a flash signal which activates and deactivates the base frequency signal in such a manner as to create a desired flash pattern. The base frequency signal, as modulated by the flash sequence signal, constitutes a composite light activation signal. Additionally, the controller 4 in the present invention is capable of varying a parameter of the composite light activation signal to maintain a substantially constant photometric, or brightness, level of the LED's 2 as the temperature of the LED's varies. In particular, the controller 4 has the capability of varying the duty cycle, or percentage of on-time, of the base frequency signal, which is also known as pulse width modulation (PWM).

Figure 4:
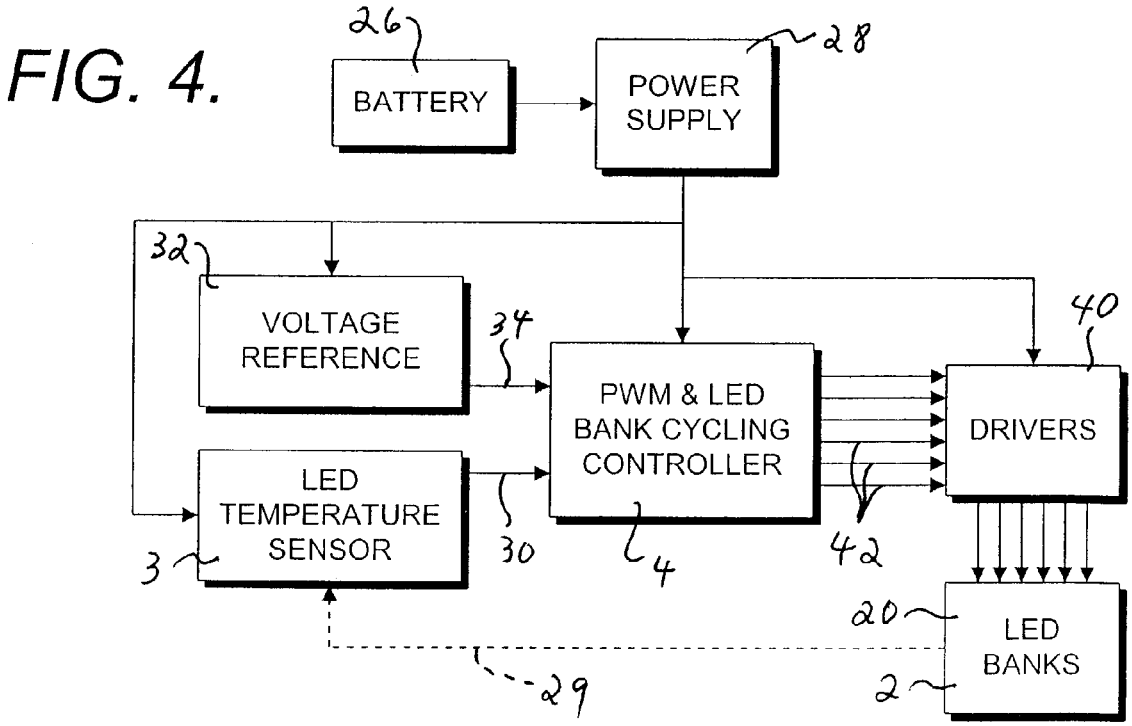
FIG. 4 is a diagram similar to FIG. 3 and illustrates an alternative embodiment of the temperature compensated warning light in which groups of light emitting diodes are activated in sequences.

The temperature sensor 3 is thermally coupled with at least one of the LED's 2, or mounted in such a manner that the temperature sensed by the sensor 3 is representative of the temperature of the LED's 2, as is diagrammatically indicated at 29 in FIGS. 3 and 4. The preferred sensor 3 has a voltage output which varies in proportion to the temperature sensed by it. The sensor 3 is connected across the power supply 28, as in a voltage divider relationship with a resistor (not shown). The conductivity of the sensor 3 varies with temperature, so that the voltage drop across it precisely tracks the sensed temperature. The temperature sensor 3 is connected to a temperature sensor terminal 30 of the controller 4. The controller 4 is programmed to maintain, as practical as possible, a constant brightness of the LED's 2. The relationship between the sensed temperature and the pulse width of the base frequency signal may be linear, stepped, or generally curved, as is necessary for the intended outcome. Generally, as the temperature of the LED's 2 increases, their brightness decreases. To compensate, the controller 4 decreases the duty cycle or pulse width of the base frequency signal as the temperature increases to allow the LED's to cool. Conversely, if the ambient temperature is particularly cold, the controller 4 increases the pulse width of the base frequency signal to thereby maintain the brightness of the LED's 2 at a desired level.

A controller product which is suitable for use as the PWM controller 4 in the circuitry 14 of the present invention is a model PIC12C671 manufactured by Microchip Technology, Inc. of Chandler, Ariz. (www.microchip.com). An appropriate temperature sensor product for use as the temperature sensor 4 in the circuitry 14 is a model LM335 precision temperature sensor manufactured by National Semiconductor Corporation of Santa Clara, Calif. (www.national.com) and others. Alternatively, other circuit implementations are possible and foreseen.

The circuitry 14 also has the capability of maintaining constant brightness of the LED's 2 in response to variations in the voltage level of the battery 26. The voltage output of the battery 26, as a vehicle battery, can vary due to ambient temperature, battery loading, engine speed, battery age and condition, and the like. To compensate for variations in LED brightness resulting from battery voltage changes, the controller 4 monitors the voltage of the battery 26 by way of the output voltage of the power supply 28 as compared to the output voltage of voltage reference circuitry 32 connected to the power supply 28. The controller 4 varies the pulse width of the base frequency signal to compensate for variations in the voltage of the battery 26. The voltage reference circuit 32 may be biased or calibrated through a voltage divider circuit (not shown) connected across the power supply 28 with a tap connected to a voltage sensing terminal 34 of the controller 4.

The controller 4 is programmed to increase the pulse width of the base frequency signal if the battery voltage drops or to decrease the pulse width if the battery voltage rises to thereby maintain a steady brightness of the LED's 2 in response to variations in battery voltage. The controller 4 may be programmed to make some adjustment to the pulse width of the base frequency signal due to sensed LED temperature and further adjustment due to a variation in sensed battery voltage. Alternatively, the controller 4 may be programmed to give priority to either LED temperature variation or battery voltage variation.

The circuitry 14 shown in FIG. 3 activates all the banks 20 of LED's 2 in unison, using any of a number of flash patterns to create an effective visual warning. For example, the LED banks 20 can be flashed in unison with equal on-time and off-time. Alternatively, the flash pattern can include multiple flashes, such as three, followed by an extended off-time, in a repeating pattern. The controller 4 can be programmed to enable a user to select from a number of different flash patterns, including the capability of alternating patterns.

The circuitry 14 shown in FIG. 4 includes all the capabilities of the circuitry shown in FIG. 3, with the added capability of activating the LED banks 20 sequentially. For sequential flashing of the banks 20, multiple drivers 40, such as six drivers, are provided, one driver 40 for each LED bank 20 or circuit card 18. Each driver 40 is connected to a separate LED activation output 42 of the controller 4. The controller 4 can activate the LED banks 20 in unison by writing a word to the outputs 42 which contains all activation bit states. For sequential activation, the controller sequentially writes words to the outputs with one activation bit state and the rest deactivation bit states, with the active bit moving sequentially from output 42 to output 42. With the omnidirectional arrangement of the LED bank cards 18 shown in FIG. 2, the controller can generate a flash sequence with the appearance of a rotating light in either a clockwise or counterclockwise direction. With a linear arrangement of the cards 18 (not shown), the controller can create linear directional flash patterns, for example to direct traffic to one side or the other of the light apparatus 1.

It is to be understood that while certain forms of the present invention have been illustrated and described herein, it is not to be limited to the specific forms or arrangement of parts described and shown.

What is claimed and desired to secure by Letters Patent is:

1. A temperature compensated warning lamp apparatus for use with an electrical power source and comprising:

(a) an electrical illumination element illuminated by an activation signal at a photometric level related to a selected electrical parameter of said activation signal;

(b) a temperature sensor thermally engaged with said illumination element and cooperating with said illumination element and an electrical power source to vary said selected electrical parameter of said activation signal in relation to an element temperature of said element sensed by said sensor to thereby control said photometric level of said element in relation to said element temperature;

(c) an illumination controller coupled to said illumination element and having said temperature sensor coupled thereto;

(d) said controller generating said activation signal as a pulse width modulated activation signal of which a pulse width can be varied to thereby vary said photometric level of said illumination element; and (e) said controller cooperating with said temperature sensor to vary said pulse width of said activation signal in relation to said element temperature.

2. An apparatus as set forth in claim 1 wherein:

(a) said photometric level of said illumination element decreases in response to said element temperature exceeding a particular element temperature; and (b) said controller reduces said pulse width of said activation signal in response to said element temperature exceeding said particular element temperature to thereby maintain said photometric level within a selected range.

3. An apparatus as set forth in claim 1 wherein said photometric level of said illumination element is related to a power source voltage of an electrical power source coupled thereto, and including:

(a) said controller monitoring said power source voltage when coupled to such a power source; and (b) said controller varying said pulse width of said activation signal in response to variation in said power source voltage in such a manner as to maintain said photometric level of said illumination element within a selected range.

4. A temperature compensated warning lamp apparatus for use with an electrical power source and comprising:

(a) a plurality of light emitting diodes illuminated by an activation signal at a photometric level related to a selected electrical parameter of said activation signal and related to a diode temperature of said diodes;

(b) a temperature sensor thermally engaged with at least one of said diodes and sensing a diode temperature of the engaged diode;

(c) an illumination controller coupled to said diodes and having said temperature sensor coupled thereto, said controller generating said activation signal;

(d) said illumination controller cooperating with said temperature sensor to vary said selected parameter of said activation signal in response to variation of said diode temperature in such a manner as to maintain said photometric level of said diodes within a selected range;

(e) said controller generating said activation signal as a pulse width modulated activation signal of which a pulse width can be varied to thereby vary said photometric level of said diodes; and (f) said controller cooperating with said temperature sensor to vary said pulse width of said activation signal in response to variation in said diode temperature to maintain said photometric level within said selected range.

5. An apparatus as set forth in claim 4 wherein:

(a) said photometric level of said diodes decreases in response to said diode temperature exceeding a particular diode temperature; and (b) said controller reduces said pulse width of said activation signal in response to said diode temperature exceeding said particular diode temperature to thereby maintain said photometric level within said selected range.

6. An apparatus as set forth in claim 4 wherein said photometric level of said diodes is related to a power source voltage of an electrical power source coupled thereto, and including:

(a) said controller monitoring said power source voltage when coupled to such a power source; and (b) said controller varying said pulse width of said activation signal in relation to said power source voltage in such a manner as to maintain said photometric level of said diodes within said selected range.

7. A temperature compensated warning lamp apparatus for use with an electrical power source and comprising:

(a) a plurality of light emitting diodes illuminated by an activation signal at a photometric level related to a selected electrical parameter of said activation signal and related to a diode temperature of said diodes;

(b) a temperature sensor thermally engaged with at least one of said diodes and sensing a diode temperature of the engaged diode;

(c) an illumination controller coupled to said diodes and generating said activation signal as a pulse width modulated activation signal of which a pulse width can be varied to thereby vary said photometric level of said diodes; and (d) said controller cooperating with said temperature sensor to vary said pulse width of said activation signal in response to variation in said diode temperature to maintain said photometric level within a selected range.

8. An apparatus as set forth in claim 7 wherein:

(a) said photometric level of said diodes decreases in response to said diode temperature exceeding a particular diode temperature; and (b) said controller reducing said pulse width of said activation signal in response to said diode temperature exceeding said particular diode temperature to thereby maintain said photometric level within said selected range.

9. An apparatus as set forth in claim 7 wherein said photometric level of said diodes is related to a power source voltage of an electrical power source coupled thereto, and including:

(a) said controller monitoring said power source voltage when coupled to such a power source; and (b) said controller varying said pulse width of said activation signal in relation to said power source voltage in such a manner as to maintain said photometric level of said diodes within said selected range.

10. An apparatus as set forth in claim 7 and including:

(a) said controller cooperating with said diodes to generate an activation signal which causes said diodes to flash in a selected flash pattern.

11. An apparatus as set forth in claim 7 and including:

(a) said diodes being interconnected in groups of diodes;

(b) said controller being coupled to said groups of diodes; and (c) said controller cooperating with said groups of diodes to generate said activation signal which causes said groups of diodes to flash in a selected flash sequence.

12. An apparatus as set forth in claim 7 and including:

(a) said diodes being interconnected in groups of diodes, said groups of diodes being positioned in outwardly facing relation about an axis;

(b) said controller being coupled to said groups of diodes; and (c) said controller cooperating with said groups of diodes to generate said activation signal which causes said groups of diodes to flash in a repeating flash sequence about said axis to give an appearance of a rotating light.

* * * * *